US005890813A

United States Patent [19]

Kasai et al.

[11] Patent Number: 5,890,813

[45] **Date of Patent: *Apr. 6, 1999**

[54] STUFFING PUMP FOR USE IN APPARATUS FOR STUFFING SAUSAGES OR THE LIKE

[75] Inventors: Minoru Kasai; Nobuo Kimura, both of Yokohama, Japan

[73] Assignee: Hitec Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 679,213

[22] Filed: Jul. 12, 1996

[30] Foreign Application Priority Data

Jul. 16, 1995 [JP] Japan ..... 7-202802

[51] Int. Cl.[6] ..... F16C 19/22

[52] U.S. Cl. ..... 384/484; 384/559

[58] Field of Search ..... 222/238, 55; 452/46; 384/484, 147, 559

[56] References Cited

U.S. PATENT DOCUMENTS

| | | | |
|---|---|---|---|
| 4,032,049 | 6/1977 | Roberts | 222/238 |
| 4,347,646 | 9/1982 | Staudenrausch | 222/55 |
| 4,539,796 | 9/1985 | Nakamura et al. . | |
| 4,694,536 | 9/1987 | Townsend . | |
| 5,064,401 | 11/1991 | Kasai et al. . | |
| 5,092,813 | 3/1992 | Kasai et al. . | |

FOREIGN PATENT DOCUMENTS

| | | |
|---|---|---|
| 59-39095 | 9/1984 | Japan . |
| 59-41971 | 12/1984 | Japan . |
| 60-2778 | 1/1985 | Japan . |

OTHER PUBLICATIONS

*Technical Manual 22162–1E–2*, "Townsend SuperMAtic RT6+Sausage Forming Machine," Townsend Engineering Co., DesMoines, Iowa (Feb. 8, 1994).

*Primary Examiner*—Lenard A. Footland
*Attorney, Agent, or Firm*—Nixon & Vanderhye

[57] ABSTRACT

A stuffing pump for use in an apparatus for stuffing sausages or the like in which a rotating shaft for rotatively driving a rotor disposed in a housing is supported by bearings at one end thereof. A shaft member coupled to another end portion of the rotating shaft by a fitting and coupling structure is provided, and the shaft member is supported by a rolling bearing so that the rotating shaft is supported on both sides with respect to the rotor.

14 Claims, 6 Drawing Sheets

STUFFING PUMP FOR USE IN APPARATUS FOR STUFFING SAUSAGES OR THE LIKE

BACKGROUND OF THE INVENTION

1. Field of the Invention

The present invention relates to improvements of a stuffing pump for use in an apparatus for manufacturing sausages or the like, and more particularly to improvements of a stuffing pump for metering and discharging a raw material of a food product, such as an emulsion product, a coarsely chopped or ground meat-like product, or the like which is a raw material of sausages or the like.

2. Description of the Related Art

Referring to FIG. 1, a description will be given hereafter of an overall structure of an apparatus for stuffing sausages or the like to which the present invention is applied.

In the drawing, a stuffing pump 1 meters and discharges into a stuffing nozzle 2 an emulsion-like or coarsely chopped or ground material to be stuffed. An unillustrated casing which is supplied from an accommodating box 3 is fitted over the stuffing nozzle 2. The casing stuffed with the material to be stuffed by the stuffing nozzle 2 is linked by a chuck 4 and a conveying device 5, and is suspended by a suspending device 7 via a guide 6.

The stuffing pump 1 in the above-described conventionally known apparatus for manufacturing sausages or the like meters and discharges a material to be stuffed of sausages or the like, and has the following structure as shown in FIG. 2.

Namely, a gear 11 serving as a rotor of a pump is provided inside a housing 13 for forming the stuffing pump 1, and a rotating shaft 12 for rotatively driving the gear 11 is provided. The rotating shaft 12 is supported in a cantilevered manner within the housing 13 with respect to the gear 11 by means of a rolling bearing 14 and a rolling bearing 15 which are provided between the rotating shaft 12 and the housing 13.

A cover 16 for covering an end portion of the rotating shaft 12 is fitted to the housing 13 to form a pump chamber.

With the above-described conventionally known stuffing pump, since the rotating shaft 12 is supported in a cantilevered manner with respect to the rotor 11, the following technical problems have been encountered.

Namely, the discharge pressure which occurs in the stuffing pump 1 varies substantially depending on the type of the material to be stuffed of sausages (coarsely chopped or ground material, emulsion, beef, pork, and oil) as well as the temperature of the material to be stuffed. An increase in the discharge pressure increases the deflection of the rotating shaft 12, with the result that there has been a problem in that the wear of the rolling bearing 14 and the rolling bearing 15 is promoted, or the gear 11 slides in contact with the housing 13, thereby causing the gear 11 and the housing 13 to become worn.

In addition, in a case where the length of the casing used is made long to improve productivity, the length of the stuffing nozzle 2 is also made long. However, the above-described deflection of the rotating shaft 12 also occurs in the case where, to improve productivity, the long stuffing nozzle 2 is used and the discharge rate of the stuffing pump 1 is increased by increasing the number of revolutions.

Thus, in the case where the conventionally known cantilevered rotating shaft 12 is used, if an attempt is made to improve productivity by using a long casing, or a stuffing raw material of a kind which is difficult to pass through the stuffing nozzle 2 is used, a drawback in durability is encountered.

SUMMARY OF THE INVENTION

Accordingly, it is an object of the present invention to provide a stuffing pump for use in an apparatus for manufacturing sausages or the like which is capable of overcoming the drawbacks of the above-described conventionally known stuffing pump for use in an apparatus for manufacturing sausages or the like, and is capable of improving productivity and durability.

In accordance with a first aspect of the present invention, there is provided a stuffing pump for use in an apparatus for stuffing sausages or the like to discharge a material to be stuffed of sausages or the like, comprising: a housing; a rotor disposed in the housing; a rotating shaft for rotatively driving the rotor; a bearing portion for supporting the rotating shaft at one end end portion thereof; and a rolling bearing provided at another end portion of the rotating shaft for supporting the rotating shaft at the other end portion thereof, the rotor being disposed on the rotating shaft at a position between the rolling bearing and the bearing portion.

In accordance with a second aspect of the present invention, in the stuffing pump for use in an apparatus for stuffing sausages or the like according to the first aspect of the present invention, the other end portion of the rotating shaft is constituted by a shaft member coupled by a fitting and coupling structure, and the shaft member is supported by the rolling bearing.

The stuffing pump for use in an apparatus for stuffing sausages or the like according to the first aspect of the present invention may further comprise: a seal member abutting against an outer periphery of the other end portion of the rotating shaft; and a seal plate for holding the seal member.

In accordance with a third aspect of the present invention, the stuffing pump for use in an apparatus for stuffing sausages or the like according to the first aspect of the present invention may further comprise: a seal member abutting against an outer periphery of the other end portion of the rotating shaft; and a seal plate for holding the seal member, wherein the other end portion of the rotating shaft is constituted by a shaft member coupled by a fitting and coupling structure.

In the stuffing pump for use in an apparatus for stuffing sausages or the like according to the second aspect of the present invention, the fitting and coupling structure is a fitting structure using a projection and a recessed portion, and a recessed structure is provided on the shaft member.

In the stuffing pump for use in an apparatus for stuffing sausages or the like according to the second aspect of the present invention, the fitting and coupling structure is a fitting structure using a projection and a recessed portion, and a projecting structure is provided on the shaft member.

The stuffing pump for use in an apparatus for stuffing sausages or the like according to the third aspect of the present invention may further comprise: a second seal member provided between the rolling bearing provided at the other end portion of the rotating shaft and the seal member.

In accordance with a fourth aspect of the present invention, there is provided a stuffing pump for use in an apparatus for stuffing sausages or the like to discharge a material to be stuffed of sausages or the like, comprising: a housing; a rotor disposed in the housing; a rotating shaft for rotatively driving the rotor; a bearing portion for supporting the rotating shaft at one end end portion thereof; a slide bearing provided at another end portion of the rotating shaft for supporting the rotating shaft at the other end portion thereof; a seal member abutting against an outer periphery of the other end portion of the rotating shaft; and a seal plate for holding the seal member.

In accordance with the present invention, the following advantages can be offered.

Since the rotating shaft is rotatably supported by bearings which are arranged with the rotor placed therebetween, even if the pressure discharged by the rotor is large, the deflection of the rotating shaft is small, with the result that the possibility of the rotor and the housing becoming worn is reduced.

In addition, even in a case where an attempt is made to improve productivity by using a long casing, it is readily possible to increase the discharge rate of the stuffing pump by increasing the number of revolutions of the rotating shaft.

Even if an attempt is made to improve productivity by increasing the number of revolutions, or a multiplicity of kinds of material to be stuffed are used, since the wear of or damage to the bearings is minimized, it is possible to improve the durability.

Even if the rotating shaft is structured by being supported on both sides, since the disassembly and reassembly are facilitated, the cleaning operation and washing operation are facilitated, so that the arrangement is hygienic.

The above and other objects, features and advantages of the present invention will become more apparent from the following detailed description of the invention when read in conjunction with the accompanying drawings.

DESCRIPTION OF THE PREFERRED EMBODIMENTS

Referring now to the accompanying drawings, a description will be given of the preferred embodiments of a stuffing pump in accordance with the present invention.

Figure 3:
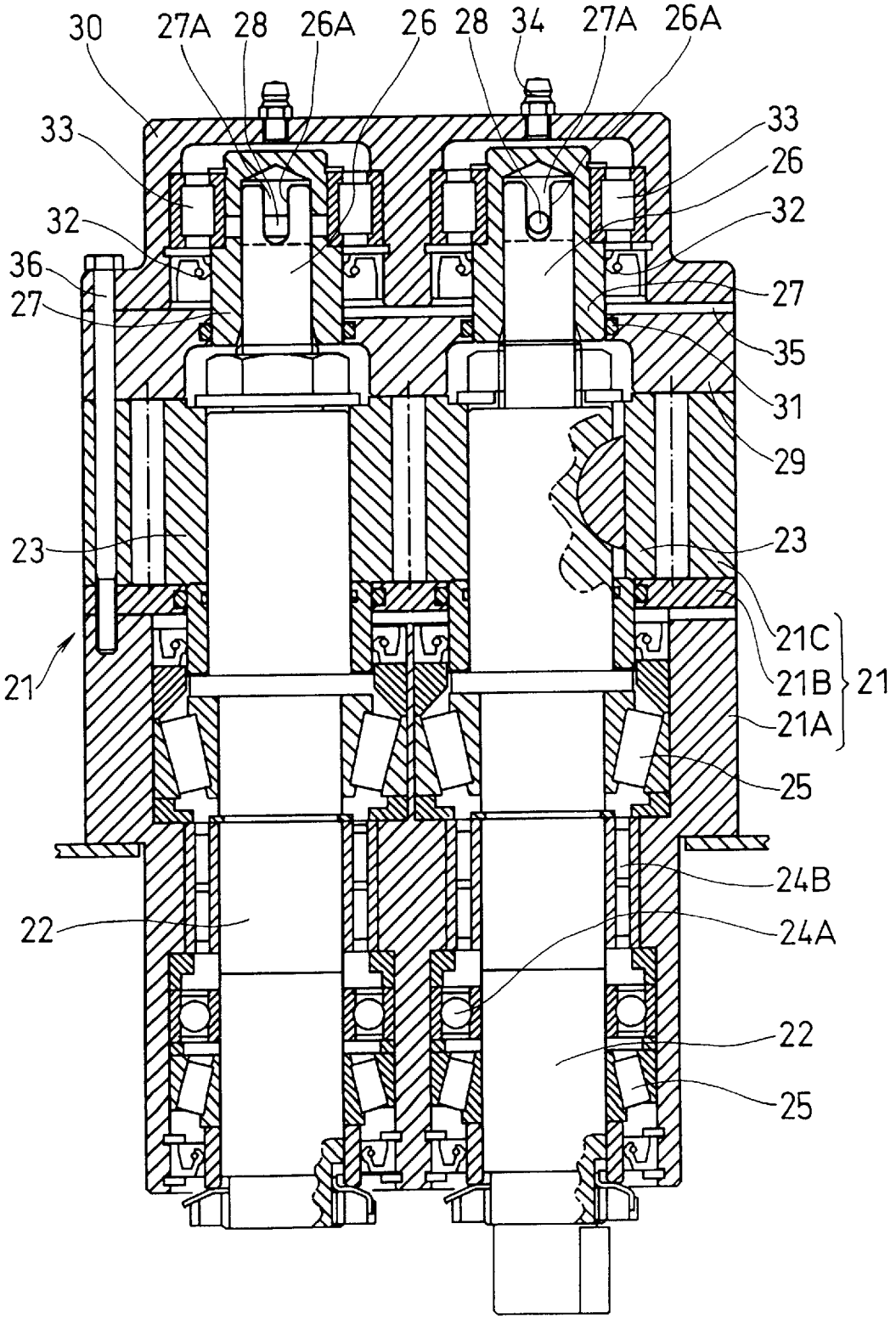
FIG. 3 is a cross-sectional view illustrating an embodiment of a stuffing pump in accordance with an embodiment of the present invention, in which the rotating shaft is supported on both sides.

Referring to FIG. 3, the stuffing pump in accordance with an embodiment of the present invention has a housing 21 which is comprised of a base 21A, a seal plate 21B, and a rotor housing 21C. Two rotating shafts 22 are provided in the base 21A, and a rotor 23 for the pump, which is constituted by a gear, is provided on each of the rotating shafts 22.

One side of the rotating shaft 22 is supported by the base 21A by means of rolling bearings 24A and 24B and a rolling bearing 25.

Figure 1:
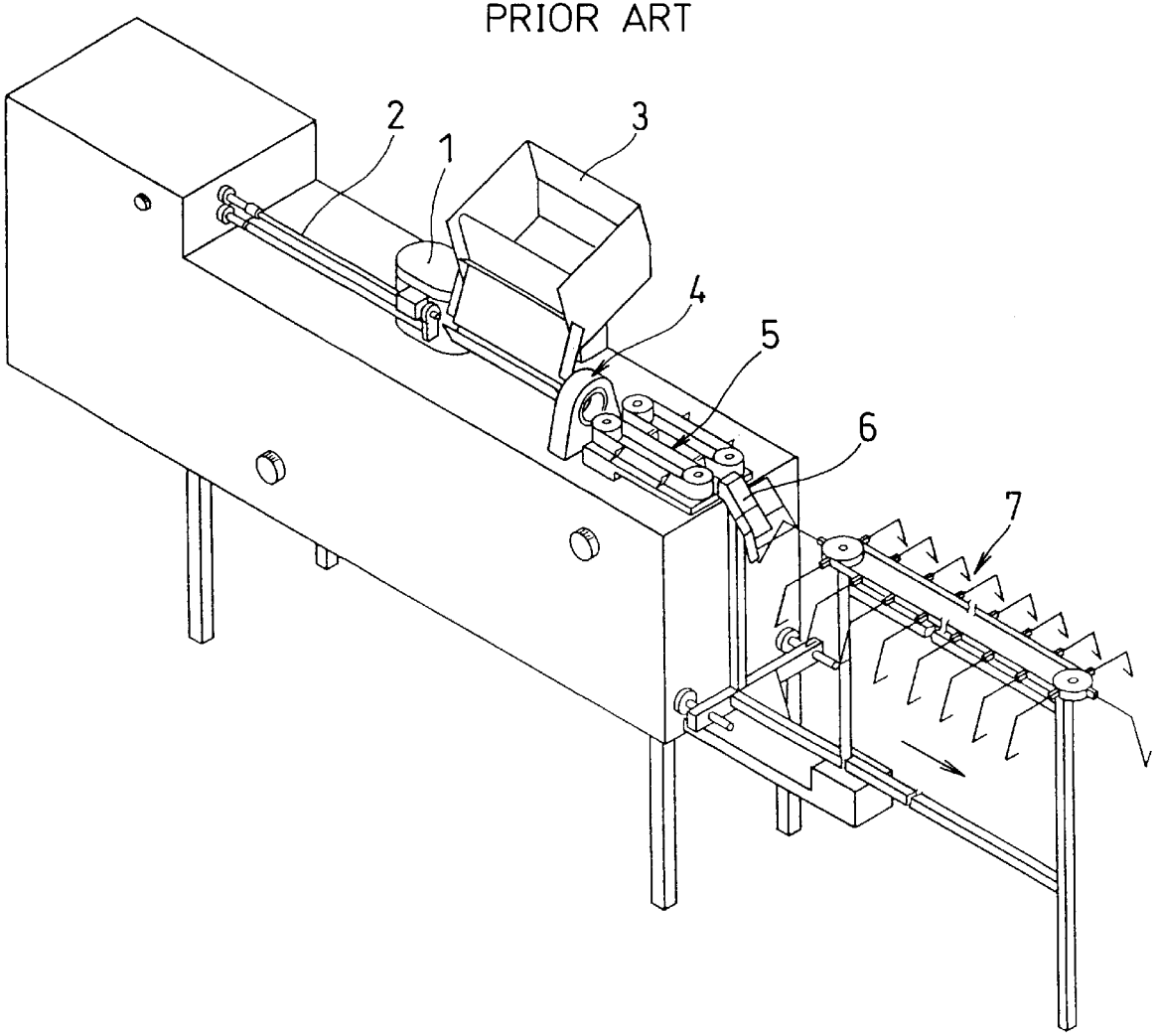
FIG. 1 PRIOR ART
FIG. 1 is a perspective view of one example of a known apparatus for stuffing sausages or the like to which a stuffing pump in accordance with the present invention is applied.
Figure 2:
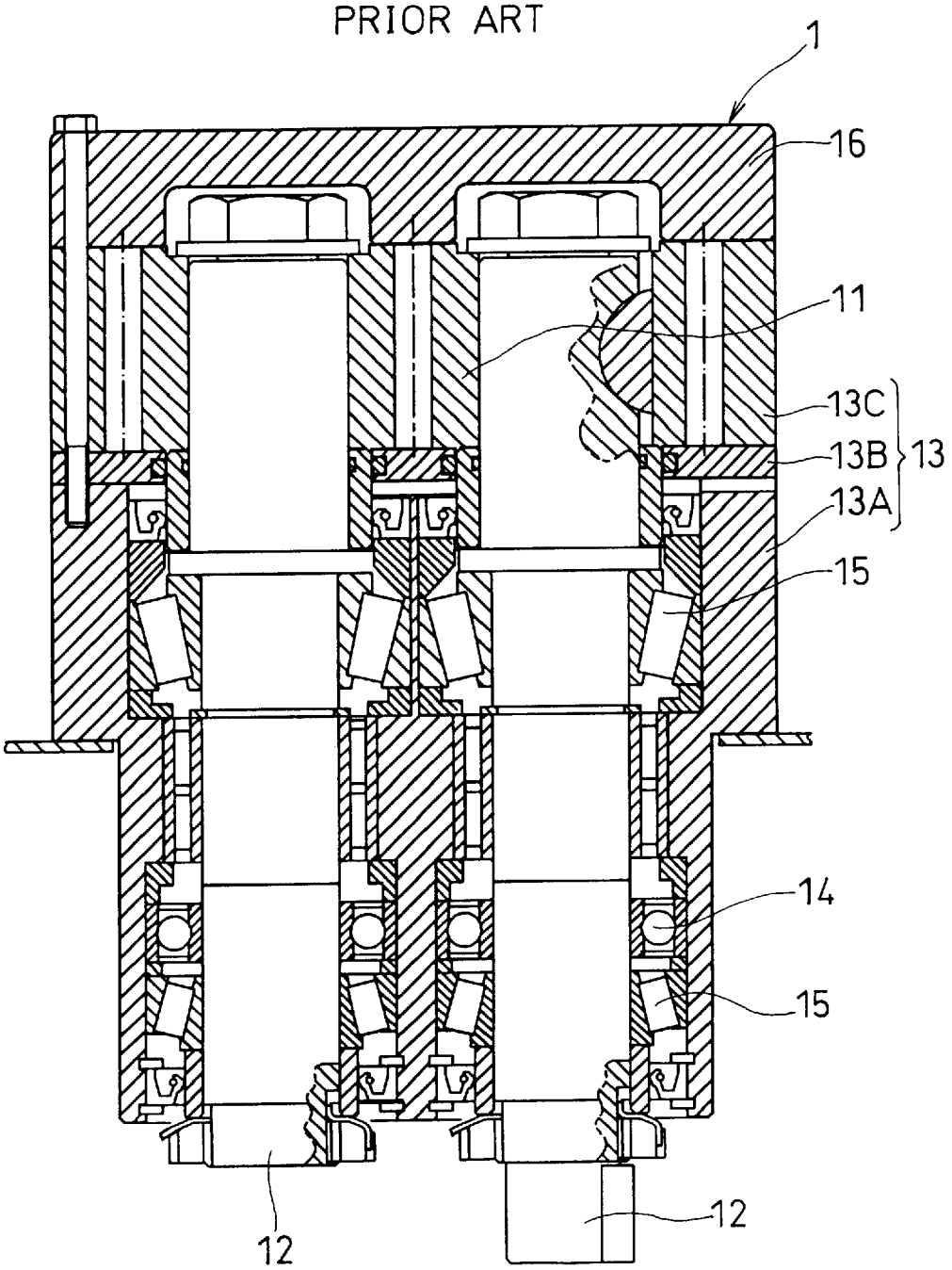
FIG. 2 PRIOR ART
FIG. 2 is a cross-sectional view illustrating a conventional stuffing pump in which a rotating shaft is supported in a cantilevered manner.

The above-described structure is similar to that of the conventionally known stuffing pump described with reference to FIG. 2, but the stuffing pump in accordance with the present invention differs from the conventionally known stuffing pump in that the rotating shaft 22 is supported on two sides with respect to the rotor 23.

Namely, a journal 26 is provided on and extends from another end portion of the rotating shaft 22, and a U-groove 26A is provided at an end face of the journal 26. A shaft member 27 is fitted to the journal 26. A pin 28 is provided in the shaft member 27 in such a manner as to be passed through a fitting hole 27A provided in the shaft member 27, and the pin 28 is engaged in the U-groove 26A of the journal 26. Consequently, the shaft member 27 rotates integrally with the rotating shaft 22. The shaft member 27 is rotatably supported by a rolling bearing 33 provided in the cover 30.

The shaft member 27 supported by the rolling bearing 33 on the cover 30 side and the rotating shaft 22 supported by the rolling bearings on the base 21A side are coupled to each other by a fitting and coupling structure in such a manner as to be detachable and such that rotation can be transmitted therebetween. In this embodiment, the journal 26, the fitting hole 27A, the U-groove 26A, and the pin 28 constitute the fitting and coupling structure.

A seal plate 29 is provided on an upper end surface of the rotor housing 21C, and the cover 30 is provided with the seal plate 29 placed between the rotor housing 21C and the cover 30. An O-ring 31 serving as a first seal member is provided on an inner periphery of a through hole formed in the seal plate 29, and the O-ring 31 is held in close contact with the outer periphery of the shaft member 27.

An oil seal 32 serving as a second seal member is provided between the shaft member 27 and the cover 30 at a position close to the O-ring 31, and the rolling bearing 33 is provided on the outer side thereof.

Grease nipples 34 for injecting grease are provided through the cover 30 to inject grease to each rolling bearing 33.

An escape groove 35 is provided in the seal plate 29 between the cover 30 and the seal plate 29, and the material to be stuffed which has leaked by passing through the O-ring 31 from the rotor housing 21C is discharged outside the housing 21 via the escape groove 35. This arrangement is provided so that a period of replacement of the O-ring 31 can be known.

The cover 30 and the seal plate 29 are secured to the housing 21 by means of attaching bolts 36. As the seal member 31, it is possible to use a seal ring such as an O-ring, a U-ring, and a V-ring, or another known seal member. The seal plate 29 having the seal member 31 suffices if it is disposed between the rotor 23 and the rolling bearing 33, and the seal plate 29 may be constructed integrally with the cover 30. As for the second seal member as well, it is possible to use not only the oil seal 32 but also the above-described seal ring or another known seal member. In this embodiment, the second seal member may not necessarily be used.

A description will be given of the operation of the stuffing pump in accordance with the embodiment of the present invention which is constructed as described above. Since the rotating shaft 22 is rotatably supported by the bearings on the housing 21 side and the cover 30 side which are disposed with the rotor 23 located therebetween, even if the discharge pressure occurring in the rotor housing 21C become large, the deflection of the rotating shaft 22 in minimized. Consequently, it is possible to reduce the wear of component parts constituting the pump, thereby preventing a decline in the durability.

In addition, the material to be stuffed in the rotor housing 21C is prevented from entering the rolling bearing 33 and the oil seal 32 by means of the O-ring 31. Even it some material to be stuffed is to pass through the O-ring, the material to be stuffed is discharged outside the housing 21 via the escape groove 35, so that the material to be stuffed does not hamper the functions of the oil seal 32 and the rolling bearing 33.

Further, since the O-ring 31 serving as the seal member is provided, grease does not enter the interior of the rotor housing 21C, so that the arrangement is hygienic. Even if grease passes through the oil seal 32, the grease is discharged outside-the housing 21 through the escape groove 35, the grease is prevented from entering the interior of the rotor housing 21C. Here, it is possible to use oil instead of grease.

Furthermore, if the attaching bolts 36 are removed, it is possible to simply remove the cover 30 and the seal plate 29, and the coupling of the shaft member 27 can be canceled simply. Hence, disassembly end reassembly are facilitated, and cleaning and washing are alas facilitated. In addition, even if the material to be stuffed enters a portion of the rolling bearing 33, by newly injecting grease through the grease nipple 34 with respect to the disassembled cover 30, it is possible to allow the grease mixed with the material to be stuffed to pass through the oil seal 32 and to be discharged outside the cover 30.

For this reason, it is possible to obtain a clean and hygienic apparatus.

The above-described embodiment employs a fitting and coupling structure using a projection and a recess wherein the journal 26 is formed projectingly on an end face of the rotating shaft 22, and the journal 26 is fitted in the tubular shaft member 27, a projecting structure (journal 26) is formed on the rotating shaft 22, and the recessed structure (fitting hole 27A) is formed in the shaft member 27. In the present invention, however, it is possible to adopt a fitting and coupling structure in which a recessed structure (fitting hole 22A) is formed in the rotating shaft 22, and a projecting structure (fitting shaft portion 37B) is formed on a shaft member 37, as will be described below.

Figure 4:
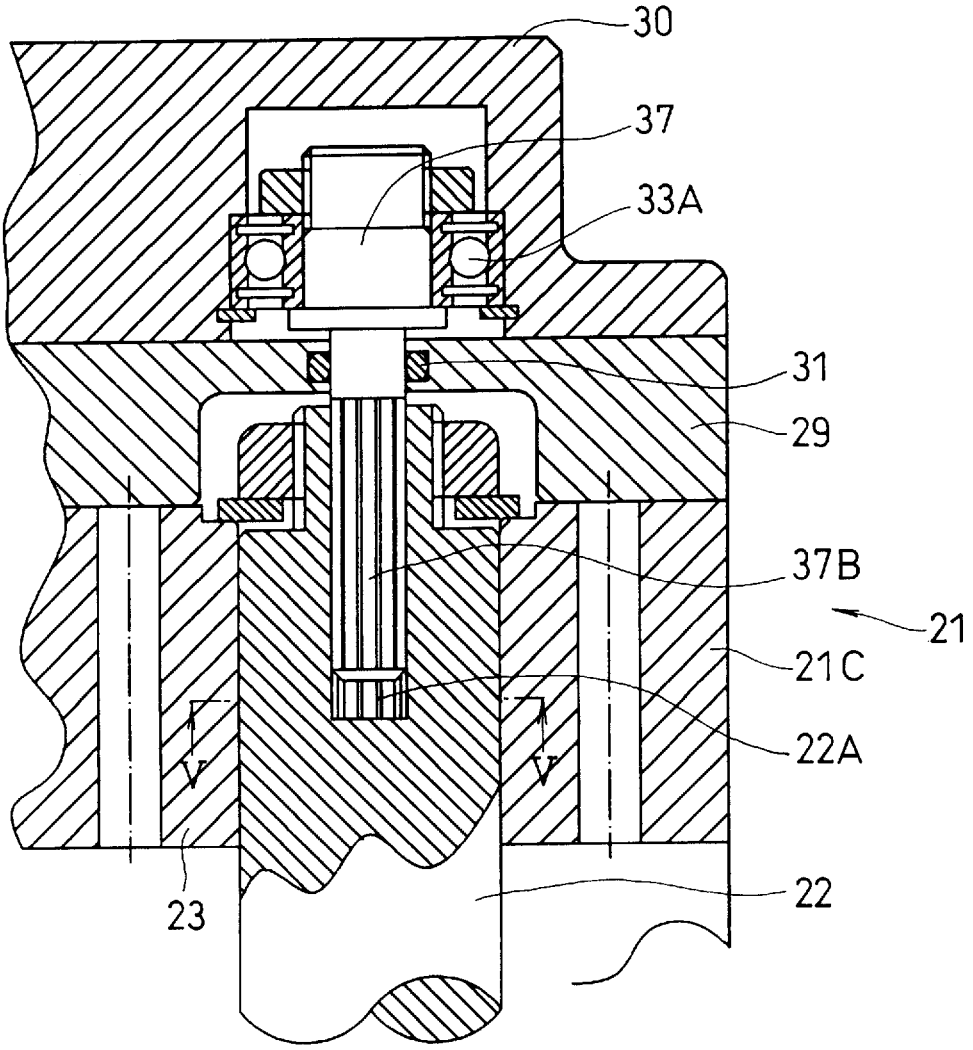
FIG. 4 is a cross-sectional view illustrating another example of a fitting structure using a projection and a recessed portion for coupling the shaft member and the rotating shaft.
Figure 5:
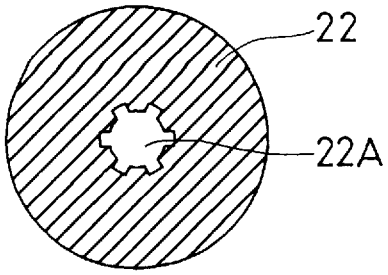
FIG. 5 is a cross-sectional view taken along line V—V shown in FIG. 5.

Namely, referring to FIGS. 4 and 5, the fitting hole 22A having a spline groove is formed at an end portion of the rotating shaft 22, and a spline shaft portion 37B serving as a fitting shaft portion which is fitted to the fitting hole 22A is formed on the shaft member 37. In this embodiment, a known sealed bearing with grease sealed in is used for a rolling bearing 33A provided in the cover 30.

Since the structure of the seal plate 29 provided with the seal member 31 is the same as the structure of the embodiment shown in FIG. 3, a description thereof will be omitted.

According to the structure of the embodiment shown in FIGS. 4 and 5, it is also possible to use the rotating shaft 22 as a cantilevered structure, as necessary, in the same way as the conventional apparatus. That is, if the shaft member 37 is removed from the rotating shaft 22, and the end portion of the rotating shaft 22 is covered with the cover 30, the structure becomes the conventional cantilevered structure, so that the apparatus can be selectively used for different uses, as required.

Next, a description will be given of the structure of an embodiment in which a slide bearing is provided at the end portion of the rotating shaft 22.

Figure 6:
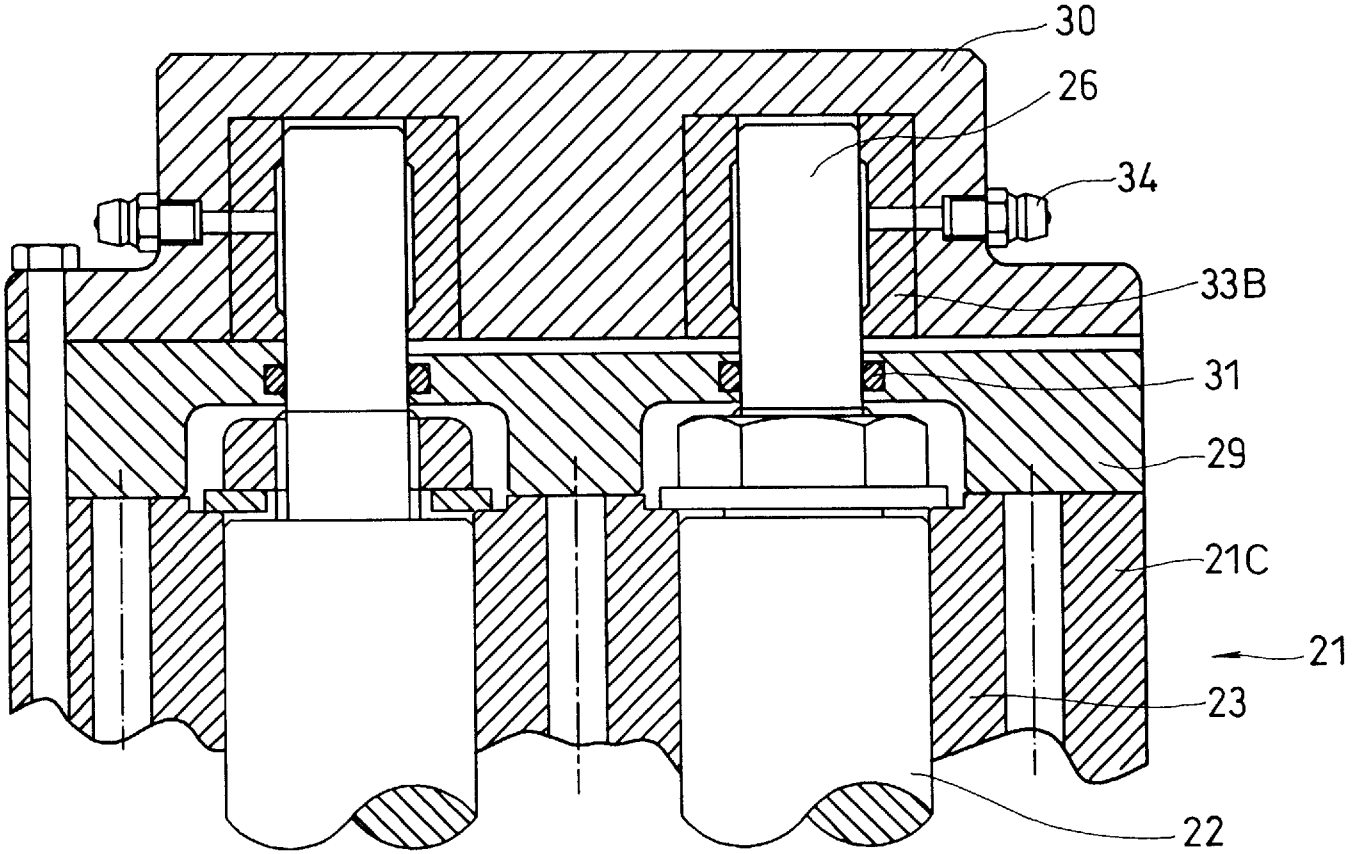
FIG. 6 is a cross-sectional view illustrating an example of a structure in which the rotating shaft is supported on both sides and a slide bearing is provided.

Namely, since the present invention has a characteristic feature in that the rotating shaft 22 is supported on two sides with respect to the rotor 23, it is possible to adopt a structure shown in FIG. 6, in which a slide bearing 33B is provided between the journal 26, which is formed at the end of the rotating shaft 22, and the cover 30. In this structure, the grease nipple 34 is provided for lubricating the slide bearing 33B, and grease is injected to sliding surfaces of the journal 26 and the slide bearing 33B.

Since the structure of the seal plate 29 provided with the seal member 31 is the same as the structure of the embodiment shown in FIG. 3, a description thereof will be omitted.

Figure 7:
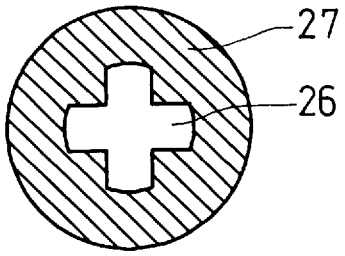
FIG. 7 is a cross-sectional view taken along line VII—VII shown in FIG. 8.
Figure 8:
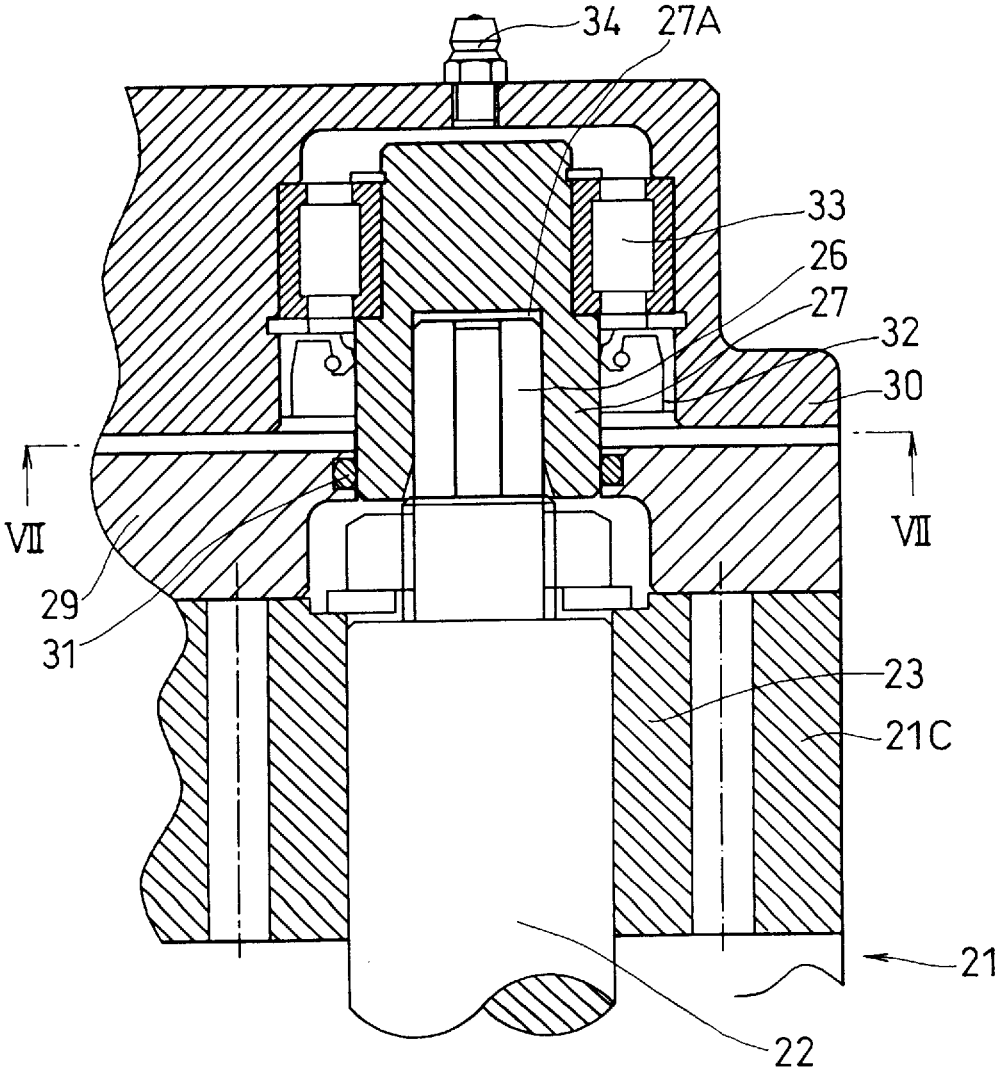
FIG. 8 is a cross-sectional view illustrating another example of the fitting structure using a projection and a recessed portion for coupling the shaft member and the rotating shaft.

Next, a description will be given of an embodiment having a different fitting and coupling structure. Namely, as shown in FIGS. 7 and 8, the journal 26 which is formed projectingly on the end of the rotating shaft 22 and the shaft member 27 having the fitting hole 27A are spline fitted, thereby meshing and coupling the rotating shaft 22 and the shaft member 27.

As is apparent from the above-described embodiments, in the present invention, it suffices insofar as the rotating shaft 22 and the shaft member 27 or 37 which are fitted to each other through the projection and the recessed portion are capable of rotating as a unit. Accordingly, the structure for transmitting the rotation of the rotating shaft 22 to the shaft member 27 or 37 is not limited to the foregoing embodiments.

In the above-described embodiments, a description has been given of the stuffing pump as a pump in which two adjacent gears mesh with each other and the material to be stuffed is metered and discharged from one side to the other. However, as the rotors 23 of the pump, it is also possible to use a pump of the type in which two rotors mesh with each other, such as a trochoid type, a lobed type, a rotary piston type, a twin rotor type, and a fan-shaped type. In addition, the present invention is applicable to a known vane pump as well.

What is claimed is:

1. A metering pump for use in an apparatus for stuffing food products into a casing therefor, comprising:

a housing including a hollow rotor housing;

a cover detachably attached to said housing;

a rotor rotatable disposed in said rotor housing, wherein an outer peripheral surface of said rotor along a rotation direction thereof is surrounded with an inner surface of said rotor housing, for metering the food products supplied to the metering pump and discharging into a stuffing nozzle said food products upon rotation of the rotor;

a rotating shaft, said rotor being attached to said rotating shaft;

a first rolling bearing disposed in said housing for rotatably supporting one side portion of said rotating shaft;

a second rolling bearing provided on said cover and having a rotatable inner race;

a shaft member fitted to said inner race of said second rolling bearing; and a fitting and coupling structure for axially movably fitting and coupling said shaft member to another side portion of said rotating shaft so as to rotate said shaft member in response to a rotation of said rotating shaft, said another side portion of said rotating shaft being rotatably supported by said second rolling bearing through said fitting and coupling structure, said fitting and coupling structure including driving means provided on said rotating shaft for transmitting a rotation of said rotating shaft to said shaft member and driven means provided on said shaft member and axially movably engaged with said driving means for rotating said shaft member in response to rotation of said rotating shaft, whereby, when said cover is axially detached from said housing, said second rolling bearing and said shaft member are simultaneously axially detached together with said cover from said housing.

2. A metering pump for use in an apparatus for stuffing food products into a casing therefor according to claim 1, wherein said pump has a gear as said rotor, and said housing has a base, and a gear housing as said hollow rotor housing, said rotating shaft having a portion to which said gear is attached, a first journalled portion disposed at said another side portion between said cover and said shaft portion to which said gear is attached, and a second journalled portion disposed at said one side portion which is at an opposite side of said shaft portion to which said gear is attached and remote from said cover, said first rolling bearing rotatably supporting said second journalled portion of said rotating shaft, said shaft member being fitted at an outer periphery thereof to an inside of said inner race of said second rolling bearing, and having a hole portion in which said first journalled portion is axially slidably fitted to said shaft member, whereby said rotating shaft is rotatably supported at said first journalled portion thereof by said second rolling bearing through said shaft member, and wherein said pump further comprises a seal member disposed between said second rolling bearing and said gear.

3. A metering pump for use in an apparatus for stuffing food products into a casing therefor according to claim 2 wherein said shaft member supports said first journalled portion which is disposed such that an end face of said first journalled portion fitted to said shaft member in said hole portion is positioned at a side of said second rolling bearing with respect to an end face of said second rolling bearing which faces to said housing.

4. A metering pump for use in an apparatus for stuffing food products into a casing therefor according to claim 2, wherein said shaft member projects toward said housing from an end face of said second rolling bearing, and said seal member abuts against an outer periphery of said shaft member.

5. A metering pump for use in an apparatus for stuffing food products into a casing therefor according to claim 2, wherein said shaft member supports said first journalled portion which is disposed such that an end face of said first journalled portion fitted to said shaft member in said hole portion is positioned at a side of said second rolling bearing with respect to an end face of said second rolling bearing which faces to said housing, and said shaft member projects toward said housing from said end face of said second rolling bearing, and wherein said pump further comprises a seal plate disposed between said housing and said cover, said seal member including a first seal member disposed in said seal plate, and abutting against an outer periphery of said shaft member and a second seal member disposed in said cover adjacent to said second rolling bearing, and abutting against the outer periphery of said shaft member.

6. A metering pump for use in an apparatus for stuffing food products into a casing therefor according to claim 1, wherein said rotor includes a first rotor and a second rotor rotatably disposed in said rotor housing, wherein outer peripheral surfaces of said first and second rotors along rotation directions thereof are surrounded with said inner surface of said rotor housing for metering the food products supplied to the metering pump and discharging into said stuffing nozzle said food products upon rotations of the first and second rotors, said first and second rotors being meshed with each other, said rotating shaft including a first rotating shaft and a second rotating shaft, said first and second rotors being attached to said first and second rotating shafts, respectively, said first rolling bearing including a third rolling bearing and a fourth rolling bearing disposed in said housing for rotatably supporting one side portions of said first and second rotating shafts, respectively, said second rolling bearing including a fifth rolling bearing and a sixth rolling bearing provided on said cover and having rotatable inner races respectively, said shaft member including a first shaft member and a second shaft member fitted to said inner races of said fifth and sixth rolling bearings, respectively, and said fitting and coupling structure including a first fitting and coupling structure and a second fitting and coupling structure for axially movably fitting and coupling said first and second shaft members to another side portions of said first and second rotating shafts so as to rotate said first and second shaft members in response to rotations of said first and second rotating shafts, respectively, whereby said another side portions of said first and second rotating shafts are rotatably supported by said fifth and sixth rolling bearings through said first and second fitting and coupling structures, respectively.

7. A metering pump for use in an apparatus for stuffing food products into a casing therefor according to claim 1, further comprising a seal member provided on said cover so as to be adjacent to said second rolling bearing, and abutting against an outer periphery of said shaft member projecting toward said housing from an end surface of said second rolling bearing.

8. A metering pump for use in an apparatus for stuffing food products into a casing therefor according to claim 1, further comprising a seal plate disposed between said housing and said cover, and a seal member provided on said seal plate and abutting against an outer periphery of said shaft member projecting toward said housing from an end surface of said second rolling bearing.

9. A metering pump for use in an apparatus for stuffing food products into a casing therefor according to claim 1, wherein said fitting and coupling structure comprises a recessed portion provided in said shaft member, a projection provided on said another side portion of said rotating shaft and disposed within said recessed portion, a rod member passing through said recessed portion and provided on said shaft member, and a groove provided in said projection, said rod member being disposed within said groove, and wherein said housing further includes a base and a first seal plate disposed between the rotor housing and said base, said metering pump further comprising a second seal plate disposed between said rotor housing and said cover, a first seal member disposed on said second seal plate and abutting against an outer periphery of said shaft member projecting toward said housing from an end surface of said second rolling bearing, and a second seal member disposed on said cover so as to be adjacent to said second rolling bearing, and abutting against said outer periphery of said shaft member.

10. A metering pump for use in an apparatus for stuffing food products into a casing therefor according to claim 1, wherein said fitting and coupling structure comprises a recessed portion provided in said shaft member, and a projection provided on said another side portion of said rotating shaft and disposed within said recessed portion.

11. A metering pump for use in an apparatus for stuffing food products according to claim 10, wherein said fitting and coupling structure further comprises a driving portion provided on said projection, and a driven portion provided on said shaft member and engaging with said driving portion to be driven by said driving portion.

12. A metering pump for use in an apparatus for stuffing food products according to claim 11, further comprising a seal member provided on said cover so as to be adjacent to said second rolling bearing, and abutting against an outer periphery of said shaft member projecting toward said housing from an end surface of said second rolling bearing.

13. A metering pump for use in an apparatus for stuffing food products according to claim 11, wherein said driving portion is comprised of a groove, and said driven portion is comprised of a rod member which is fitted to said groove.

14. A metering pump for use in an apparatus for stuffing food products according to claim 1, wherein said fitting and coupling structure comprises a recessed portion provided in a distal end of said another side portion of said rotating shaft, and a projection provided on said shaft member and disposed within said recessed portion.

* * * * *

UNITED STATES PATENT AND TRADEMARK OFFICE

CERTIFICATE OF CORRECTION

PATENT NO. : 5,890,813
DATED : April 6, 1999
INVENTOR(S) : KASAI et al

It is certified that error appears in the above-indentified patent and that said Letters Patent is hereby corrected as shown below:

Claim 1, line 5, change "rotatable" to --rotatably--.

Signed and Sealed this

Fifth Day of October, 1999

*Attest:*

*Attesting Officer*

Q. TODD DICKINSON

*Acting Commissioner of Patents and Trademarks*